US006909250B2

(12) United States Patent
Jigamian et al.

(10) Patent No.: US 6,909,250 B2
(45) Date of Patent: Jun. 21, 2005

(54) APPARATUS AND METHOD FOR OPERATING A PORTABLE XENON ARC SEARCHLIGHT

(75) Inventors: Gregory Z. Jigamian, Temecula, CA (US); George Pelling, deceased, late of Huntington Beach, CA (US); by Maureen Pelling, legal representative, Huntington Beach, CA (US); Goran Forschager, Mission Viejo, CA (US); Jeffrey P. Kennedy, Huntington Beach, CA (US)

(73) Assignee: Xenonics, Inc., Carlsbad, CA (US)

( * ) Notice: Subject to any disclaimer, the term of this patent is extended or adjusted under 35 U.S.C. 154(b) by 0 days.

(21) Appl. No.: 10/414,935

(22) Filed: Apr. 16, 2003

(65) Prior Publication Data

US 2004/0042211 A1 Mar. 4, 2004

Related U.S. Application Data

(62) Division of application No. 09/440,105, filed on Nov. 15, 1999, now Pat. No. 6,702,452.

(51) Int. Cl.[7] ..... H05B 37/02

(52) U.S. Cl. ..... 315/307; 315/291; 362/265; 362/183

(58) Field of Search ..... 315/291, 307, 315/224, 209 R, 82, DIG. 5; 362/184, 183, 263, 265

(56) References Cited

U.S. PATENT DOCUMENTS

| | | | | | |
|---|---|---|---|---|---|
| 5,142,458 | A | * | 8/1992 | Brunson | 362/184 |
| 5,317,237 | A | * | 5/1994 | Allison et al. | 315/307 |
| 5,630,661 | A | * | 5/1997 | Fox | 362/187 |
| 5,990,633 | A | * | 11/1999 | Hirschmann et al. | 315/291 |
| 6,181,084 | B1 | * | 1/2001 | Lau | 315/291 |
| 6,608,458 | B2 | * | 8/2003 | Holmes | 315/307 |

* cited by examiner

*Primary Examiner*—Tuyet Vo
*Assistant Examiner*—Ephrem Alemu
(74) *Attorney, Agent, or Firm*—Daniel L. Dawes; Myers Dawes Andras & Sherman LLP

(57) ABSTRACT

A xenon arc searchlight incorporates a high frequency/high efficiency electronic circuit that allows lamp ballasting and charging of the system battery to occur over a wide range of external DC power supplies. The xenon arc searchlight has a converter circuit coupled to both the battery, the ballasting circuit and the arc lamp for converting DC voltage from the battery to pulse width modulated switched current to the arc lamp in which the DC voltage is switched by parallel switching transistors. The ballisting circuit is controllable by a switch to vary current supplied to the converter circuit and hence intensity of the lamp which discrete steps in intensity of the lamp are not visually perceptibly different between one step to a next step in the sequence of steps of the current to the lamp. The lamp, ballast, battery and charger are provided in a single rugged package.

19 Claims, 12 Drawing Sheets

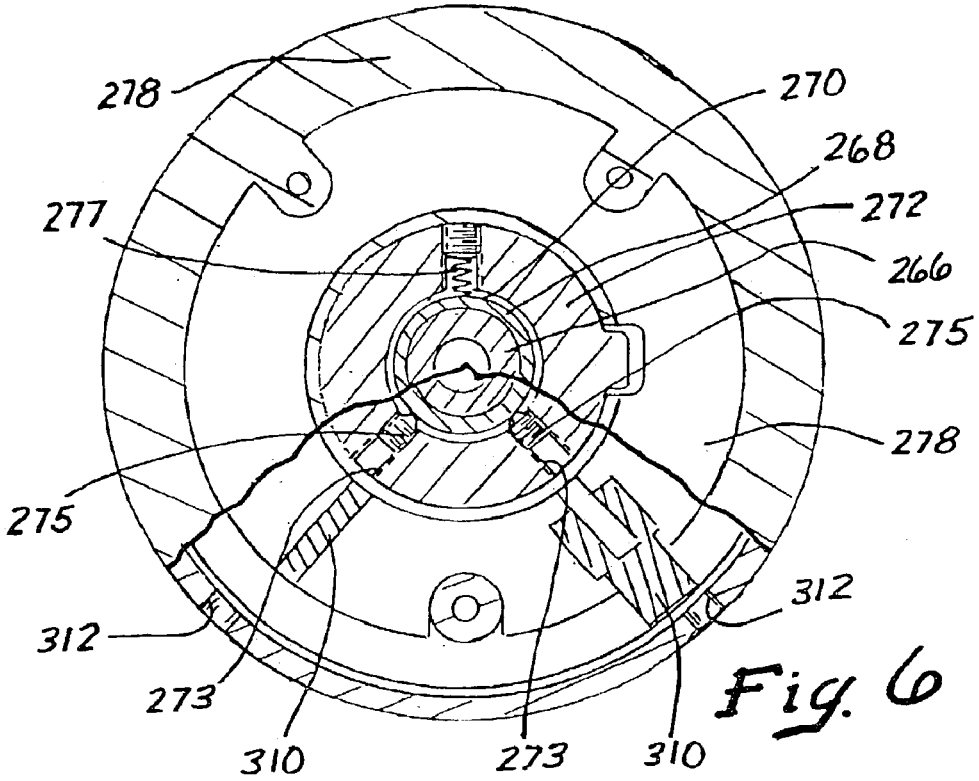
Fig. 6
Fig. 7
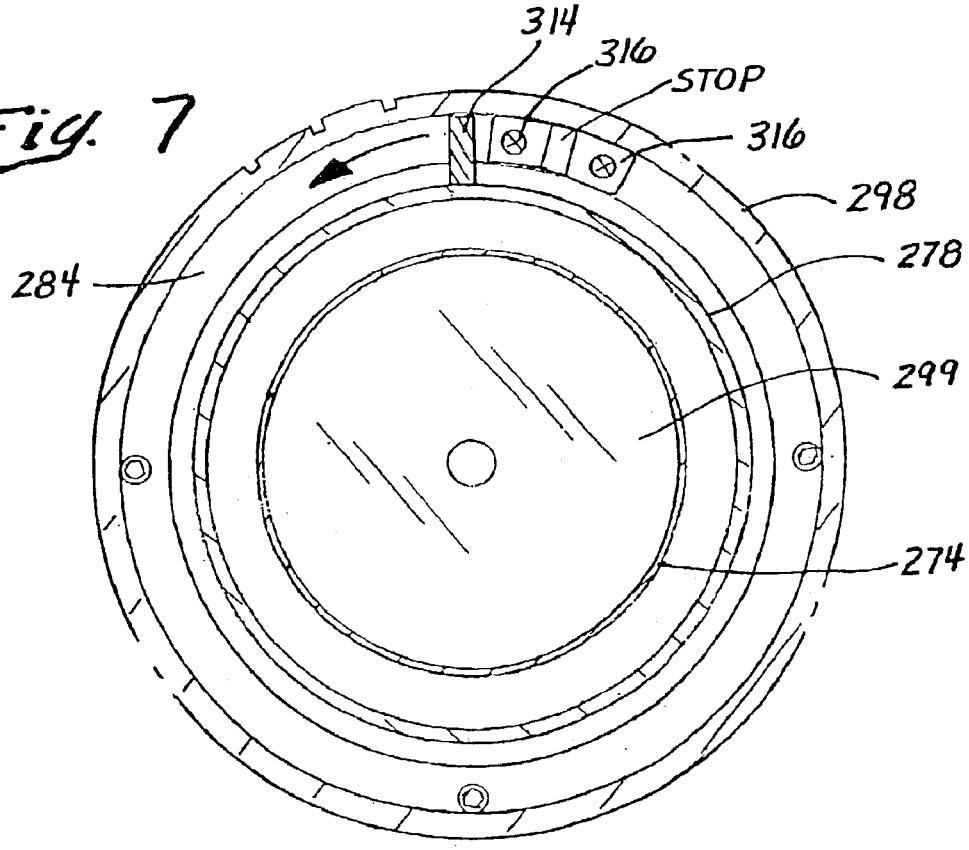

Fig. 14
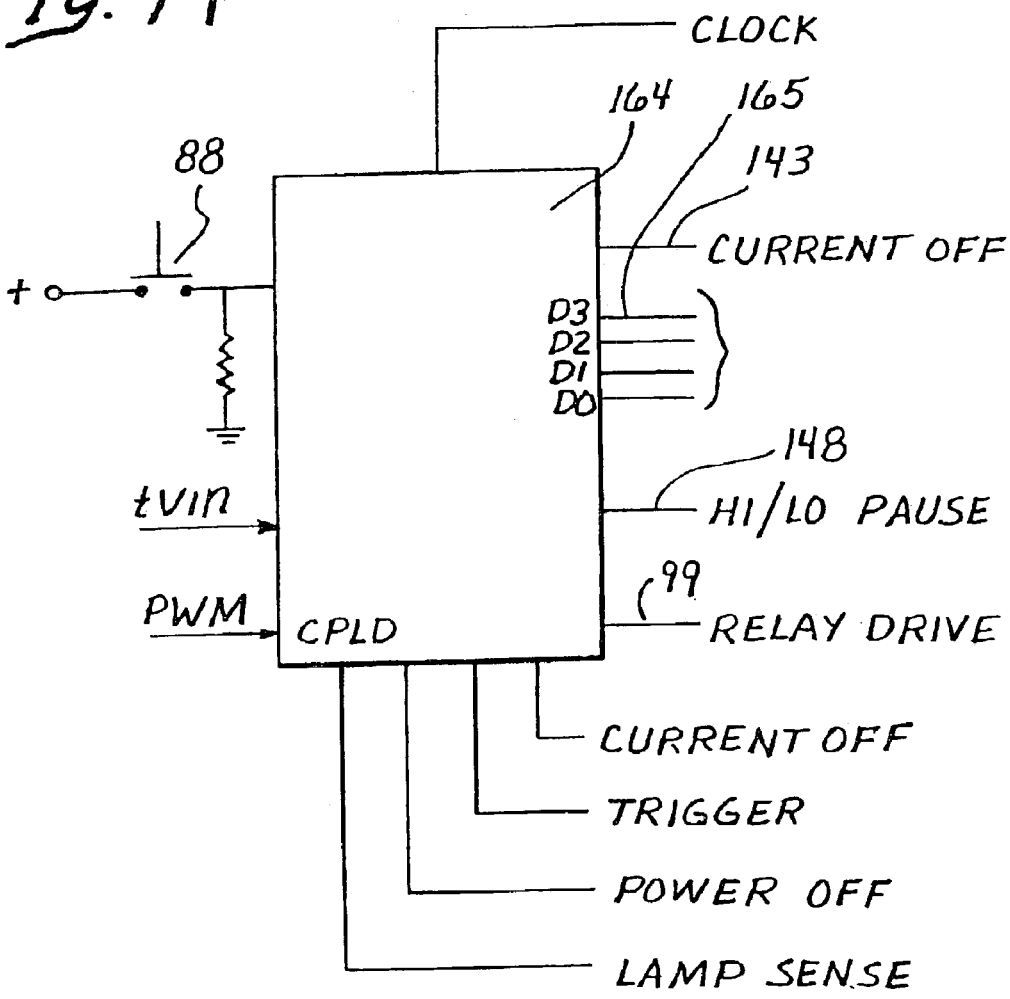
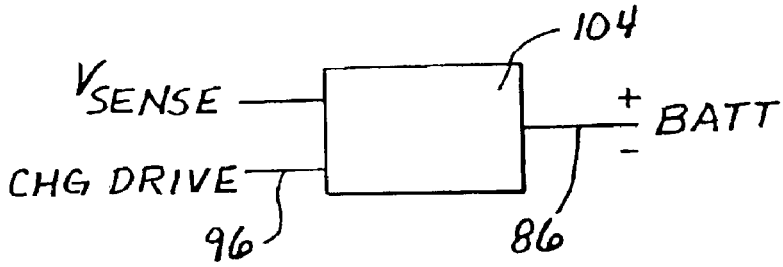
Fig. 15

APPARATUS AND METHOD FOR OPERATING A PORTABLE XENON ARC SEARCHLIGHT

RELATED APPLICATION

The present application is a division of U.S. patent application Ser. No. 09/440,105 filed on Nov. 15, 1999, now U.S. Pat. No. 6,702,452, to which priority is claim pursuant to 35 USC 120.

BACKGROUND OF INVENTION

1. Field of the Invention

The invention relates to xenon arc lamps and in particular to compact or handheld xenon short arc searchlights or illumination systems.

2. Description of Prior Art

Handheld lighting devices with focused beams or spotlights or searchlights, whether battery-powered or line-powered, are commonly used by military, law enforcement, fire and rescue personnel, security personnel, hunters and recreational boaters among others for nighttime surveillance in any application where a high intensity spotlight is required. The conditions of use are highly varied, but generally require the light to deliver a desired field of view at long distances, be reliable, durable and field maintainable in order for it to be practically used in the designed applications. Typically the light is hand carried and must be completely operable using simple and easily access manual controls which do not require the use of two hands.

In prior art xenon short-arc searchlights or illumination systems, whether handheld, portable or fixed mounted, the luminance distribution of the arc has been positioned facing in the direction of the beam (cathode to the rear), to provide a uniform beam pattern when the arc is at the focal point of the parabolic reflector. When the luminance distribution of the arc is positioned in this manner, a majority of the light output is collected in the low magnification section of the reflector and in a slightly divergent manner in the far-field. When the beam is diffused into a flood pattern, a large un-illuminated area or "black hole" is projected. Reversing the lamp position so that the full luminance distribution of the arc is in the high magnification section of the parabolic reflector produces a more concentrated beam in the near- and far-field and hence greater range can be achieved. Additionally, when the beam is diffused into a flood pattern no characteristic "black hole" of prior art configurations is produced. When the arc is moved slightly beyond (or slightly rearward of) the reflector's focal point, the combination of a placing all available light in the high magnification section of the reflector and collecting it in a slightly convergent manner produces roughly twice the operating range as a conventional anode-forward device.

The operation of the xenon arc lamp requires a power supply capable of supplying a regulated current to insure ignition of the lamp and maintenance of its operation. Typically three voltage are required to ignite an arc lamp, bring it into operation and maintain its operation, namely: (1) a high voltage RF pulse applied across the lamp electrodes to ignite or break down the non-ionized xenon gas between the lamp electrodes; (2) a second voltage higher than the operating voltage of the lamp to be applied across the lamp electrodes at the time the high voltage radio frequency (RF) pulse is applied in order to establish a glowing plasma between the electrodes; and (3) a lower voltage to sustain the flow of plasma current at a level sufficient to create a bright glow after the lamp has been ignited.

In prior art battery powered searchlights, large high voltage transformers and large storage capacitors have been required to generate a high voltage current of sufficient magnitude to power the lamp's ignition. A separate voltage boosting circuit for generating the second voltage to establish the plasma adds to the size, weight and component count of the lamp circuitry. The resulting circuitry in prior art has traditionally been less than optimum, with excessive energy lost to heat, and relegating battery running times to less than desirable.

Therefore, what is needed is an optical assembly to increase light collection efficiently and dissipate associated heat to produce a significantly more concentrated beam and a circuit topology by which the arc lamp regulated current can be supplied, but with a reduction in the size, weight and component count of the lamp circuitry and at high circuit efficiency to maximize battery life and minimize heatload.

BRIEF SUMMARY OF THE INVENTION

The invention is a searchlight for generating a beam of light comprising an arc lamp, high-efficiency electronic ballast circuitry coupled to the arc lamp, a wide range power supply plus an internal battery and battery charger coupled to the ballasting circuit for powering the ballasting circuit and the arc lamp. A single converter circuit is used both for battery charging from an external power source and ballasting an arc lamp. In the illustrated embodiment the arc lamp is a xenon arc lamp, but it expressly is intended to include other kinds of plasma lamps, including without limitation metal halide and halogen lamps. In addition, although the invention is described in terms of a portable battery powered light, nonbattery-powered or line-powered lights in fixed configurations are within the express scope of the invention. For example, the use of the claimed light in aircraft and vehicular systems is included as is simple security lighting in a fixed site.

The invention is characterized as a searchlight comprising a lamp, a reflector disposed about the lamp to reflect light generated by the lamp, a lamp holder to position the lamp precisely along the reflector's axis of optical symmetry, a reflector positioner so that the reflector is selectively moved by user with respect to the searchlight while the lamp remains fixed relative to the searchlight, and a lamp circuit coupled to the lamp for powering and controlling illumination produced by the lamp.

The lamp is a xenon arc lamp having an anode and cathode. The xenon arc lamp is mounted within the searchlight so that the anode of the xenon arc lamp is in the rearward position relative to the direction of a beam projected by the searchlight so that field illumination of the beam is slightly convergent and more concentrated and therefore delivers much longer range of operation. This orientation is unique in searchlight and illumination systems employing xenon short arc lamps.

The lamp is affixed in a lamp holder that allows precision alignment, and is designed to be quickly replaceable. The lamp module locks into a fluted heat sink to conductively dissipate lamp heat from the anode, as opposed to radiating heat in conventional anode-forward searchlights.

The reflector has an optical axis of symmetry. The lamp is positioned on the optical axis of symmetry. The reflector positioner moves the reflector in two opposing directions along the optical axis of symmetry. The lamp is radially adjustable relative to the reflector to be disposed on the optical axis of symmetry. The radial adjustment of the lamp on the optical axis is field adjustable. The reflector positioner retains the relative position of the reflector with respect to the lamp at a last relative position between the lamp and reflector which was selected when last using the searchlight. Thus, the design has a last use memory for the beam focus or adjustment.

The lamp, reflector, and reflector positioner are removable from the lamp housing as a unit to allow different reflector materials (for example nickel rhodium, aluminum, gold) to be easily substituted for maximum reflectivity depending on specific applications. The searchlight comprises a housing for containing the lamp, lamp circuit, reflector and reflector positioner.

The invention is still further characterized as a searchlight comprising a housing; a lamp disposed within the housing, a lamp circuit disposed within the housing, and a reflector disposed within the housing. The housing is characterized by a mounting fixture adapted to permit quick field coupling to a second device so that movement of the housing to direct the beam from the lamp is integrally manipulated with the second device.

The searchlight further comprises a searchlight housing in which the battery is included with the battery charging circuit, the ballasting circuit and the arc lamp as a single unit.

The electronic ballast circuitry is comprised of a converter and igniter. The converter has an output coupled across the arc lamp for providing a converted direct current (dc) current and voltage to the arc lamp. The igniter is coupled across the arc lamp to provide a high voltage RF ignition current to the arc lamp. The converter is controlled by a smooth variation of current and voltage to the arc lamp to correspondingly smoothly vary light output from the arc lamp between high and low intensities. By "smooth variation" it is meant that the changes in intensity of the lamp can be made very small so that they are not or are almost not visually perceptible by an ordinary human observer. The converter is controlled to provide the smooth variations between high and low intensities by a multiplicity of small digital current steps. Alternatively, the converter is controlled to provide the smooth variations between high and low intensities by an approximate or digitally simulated analog variation in current intensity provided to the arc lamp. The ballasting circuit is controlled by a control circuit to turn the arc lamp on after ignition at minimum intensity level of operation.

The searchlight further comprises a handle with a mounting formed as part of the housing to allow portability for the searchlight and for mounting to the second device. The mounting is a tripod mount so that the portable searchlight may be fixed in the field to a tripod with the second device. The mounting on the handle is a thumb screw mount to permit mounting of an optical detection device onto the searchlight and rigidly fixed to the housing The searchlight further comprises a field changeable filter disposed on the searchlight to select frequency ranges transmitted in the beam to a selected frequency range depending on application. The filter is selected to permit transmission of light in the beam through the filter for illumination in one of the environments comprised of illumination in a smoky environment, for infrared illumination, for underwater illumination, for ultraviolet or any specific color in the visible range. The filter can also be selected for reduction of intensity of the beam from the searchlight to present a minimum intensity output in the beam below which the arc lamp could not operate but for the filter.

The invention and its various embodiments may now be visualized by turning to the following drawings where in like elements are referenced by like numerals.

BRIEF DESCRIPTION OF THE DRAWINGS

FIG. 3*a* is a depiction of the luminance distribution of an arc from a xenon short arc lamp in a horizontal position.

FIG. 3*b* is simplified diagram of a parabolic reflector depicting the focal point and high magnification area of the reflector.

FIG. 3*c* illustrates how anode-rear positioning of a short-arc lamp places the luminance distribution in the high magnification area of the reflector.

FIG. 3*d* is a graphical comparison of the illuminance of a 75 W xenon short arc lamp in an anode-rear vs. anode-forward position.

FIG. 6 is a perpendicular cross-sectional view of the searchlight of the invention as seen through section lines 5—5 of FIG. 2.

FIG. 7 is a perpendicular cross-sectional view of the searchlight of the invention as seen through section lines 6—6 of FIG. 2.

FIG. 14 is a simplified schematic diagram of a programmed logic device in the circuit of the arc lamp of the invention.

FIG. 15 is a simplified schematic diagram of a battery charging circuit of the arc lamp of the invention.

The invention now having been illustrated in the foregoing drawings, turn now to the following detailed description of the preferred embodiments

DETAILED DESCRIPTION OF PREFERRED EMBODIMENTS

A xenon arc searchlight or illumination device incorporates a circuit that both provides for lamp ballasting and charging of the system battery from an external power source. The tolerance to variations in the system supply voltage as well as external voltage are increased by providing logic control of the converter circuit through a programmed logic device (PLD). The intensity of the arc lamp is smoothly decreased or increased in a continuous manner from a maximum intensity to a minimum intensity beam. Ignition of the lamp at its minimum illumination levels is thereby permitted. The lamp beam is narrowed or spread by relative movement of a reflector with respect to the lamp by advancing or retracting the reflector along its optical axis of symmetry on which the lamp is also aligned. The reflector has short focal length of the order of magnitude of approximately 0.3–0.4 inch which maximizes collection efficiency and beam collimation. The lamp is designed so that the lamp, reflector and battery assemblies are easily field replaceable without tools. The lamp, ballast, battery and charger are provided in a single rugged package which is sealed for field use. The searchlight is combined by an appropriate mounting adaptable with other optical detector devices such as cameras, binoculars and night vision telescopes. The beam output is similarly usable with a combination of filters to allow the most varied intensity and wavelengths for a particular application, such as smoke filled environments, surveillance employing near-infrared or infrared illumination, underwater, ultraviolet or any color in the visible range illumination. The xenon arc lamp is oriented within the searchlight with respect to the reflector to provide the most concentrated and convergent field of illumination on which the lamp is capable, namely with the anode of the lamp turned away from the forward beam direction in the reflector.

Figure 1:
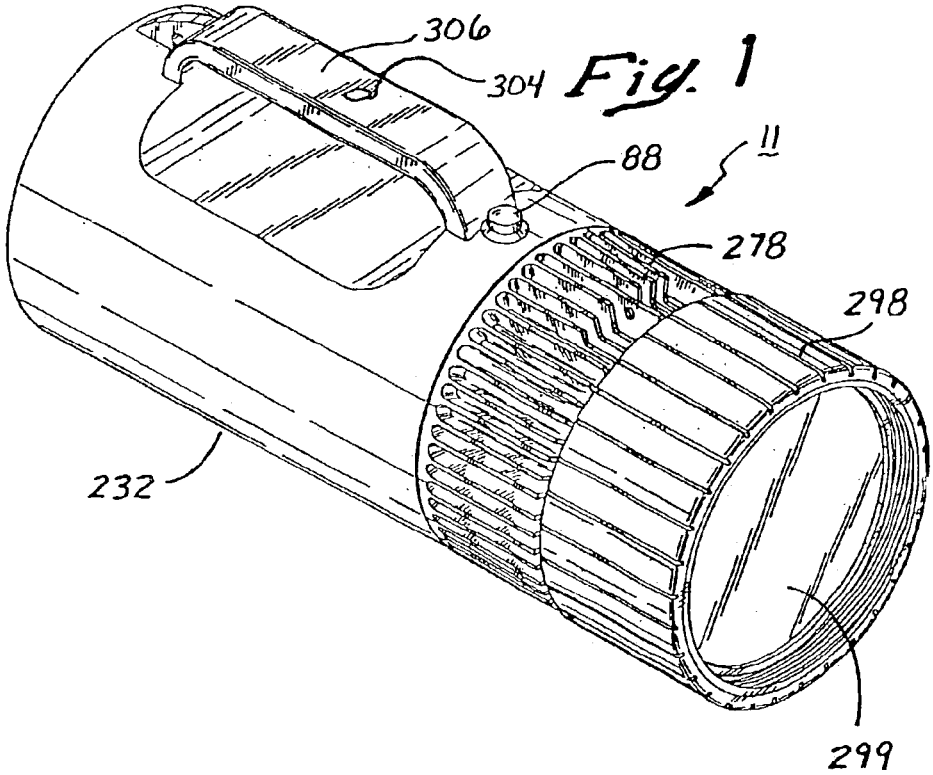
FIG. 1 is a perspective view of the assembled light.

FIG. 1 is a perspective view of searchlight 1 1 which shows a body 232, an integral handle 306 in which a mounting hole 304 is defined, a heat sink 278 and a rotatable bezel 298 in which a faceplate 299 is fixed. Pushbutton switch 88 is disposed into body 232 just forward of handle 306 where a user's thumb would normally be positioned when holding searchlight 11 by handle 306. Pushbutton switch 88 is a sealed momentary contact switch which may be provided with an internal LED which is lit when searchlight 11 is operating and may indicate different modes of operation (on; flashing for charging, solid for full charge, intermittent flash for float charge, etc.). Searchlight 11 is a compact, rugged, and portable battery powered light about the size of a large flashlight or lantern that can produce an adjustably collimated, and adjustable high intensity beam of light for more than a mile in clear atmospheric conditions.

Figure 2:
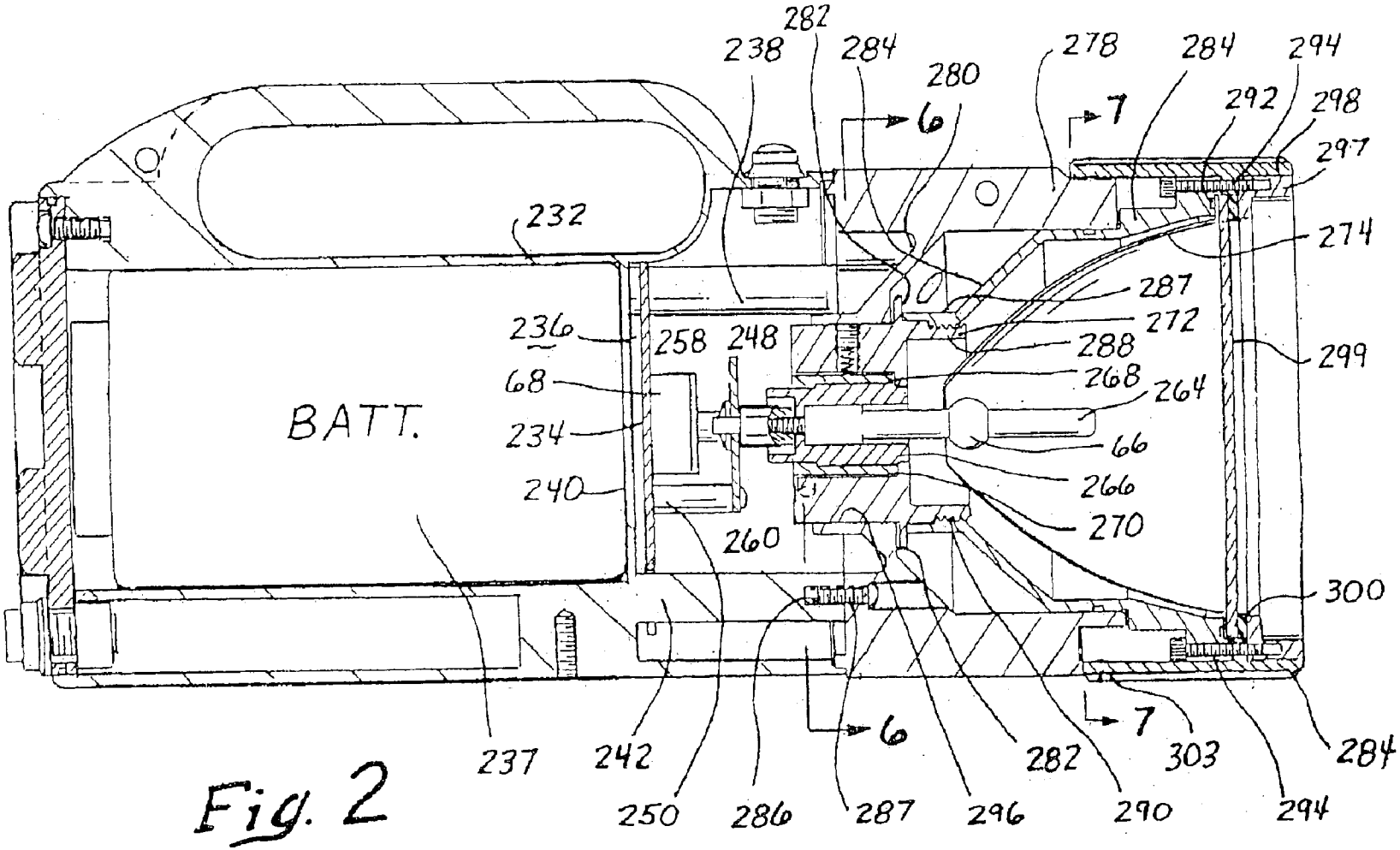
FIG. 2 is a side cross-sectional view of the light of FIG. 1 showing the interior components in an assembled configuration.
Figure 4:
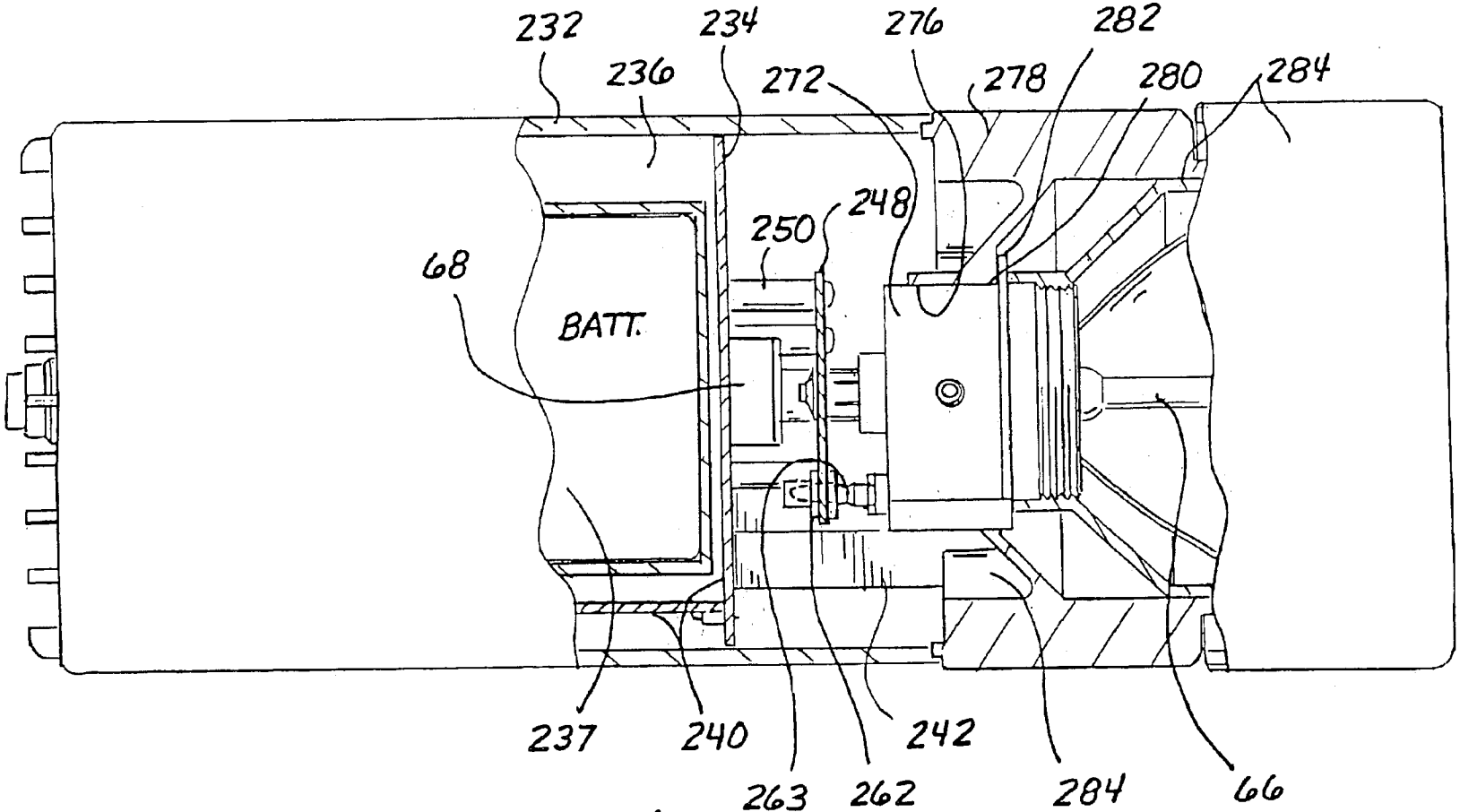
FIG. 4 is a partially cutaway bottom view of the light of FIG. 1 showing the relationship of the battery, the circuit board, the lamp and the reflector in an assembled configuration.
Figure 5:
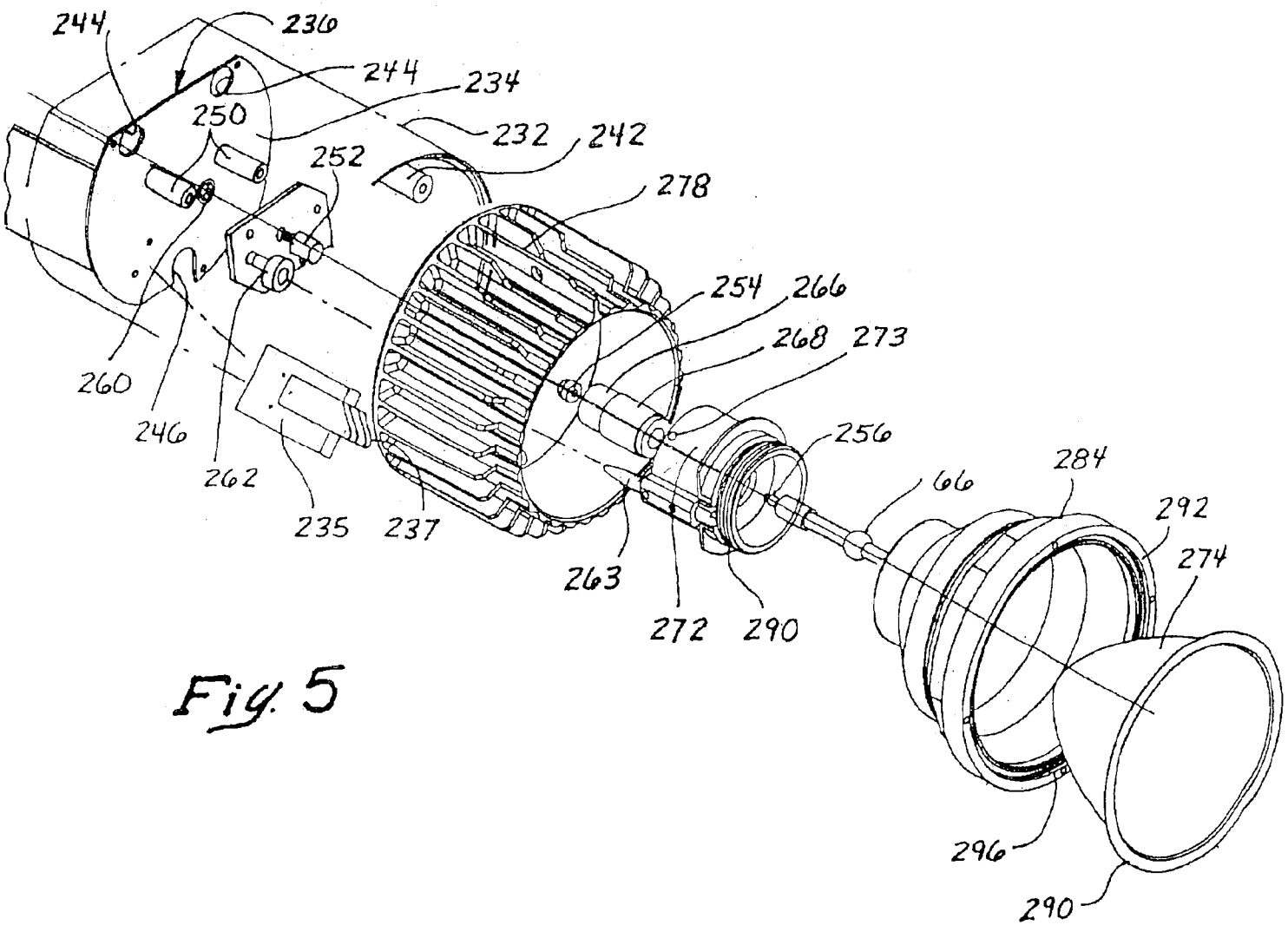
FIG. 5 is a simplified exploded view of selected components of the searchlight of the invention.

Turn now to the exploded assembly drawing of the mechanic elements of the searchlight 11 as depicted in FIG. 5. Elements of the searchlight 11 have been omitted from the drawings for the sake of simplicity of the illustration. The searchlight 11 includes a housing 232 shown in cut-away perspective view in FIGS. 2 and 4. A base plate 234 is provided behind which is a space 236 which carries the battery 237 for searchlight 11 as shown in FIGS. 2 and 4. Base plate 234 is mounted to housing 232 through molded end standoffs 238 one of which is shown in FIG. 4. The molded battery wall 240 integrally extends through standoffs 242 through holes 244 and U-shaped indentation 246 defined through circuit board 234 shown in FIG. 5.

Figure 1B:
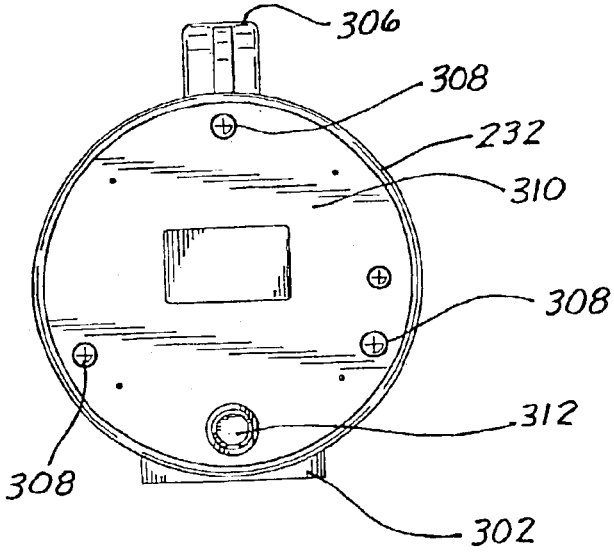
FIG. 1*b* is a rear elevational view of the assembled light of FIGS. 1 and 1*a*.

Battery 237 is accessible through the rear of housing 232 as shown in FIG. 1*b*. Three screws 308 fasten a circular rear plate 310 to housing 232. A recessed electrical connector 312 is provided in rear plate 310 through which an external power supply may be connected either to operate searchlight 11, to recharge battery 237 or both. Electrical connector 312 is recessed to provide a rugged configuration so that the connector will not be damaged by rough handling.

Figure 1A:
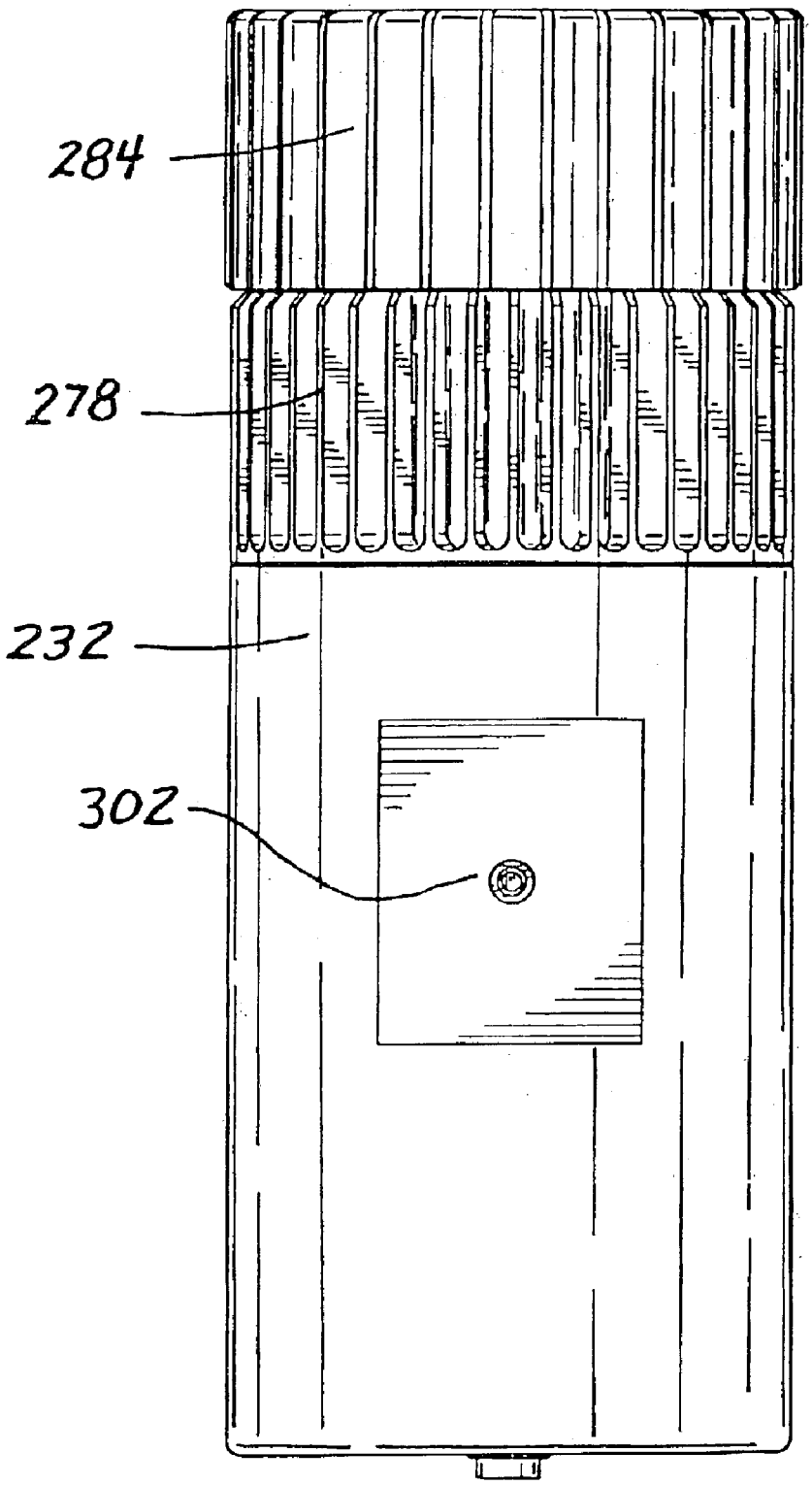
FIG. 1*a* is a bottom elevational view of the assembled light of FIG. 1.

Housing 232 incorporates a housing mounting hole 302 as shown in FIG. 1*a* on its bottom surface, an integral handle 306 and a hole 304 defined in handle 306 for receiving a handle mount with a thumb screw (not shown) with which to mount or stack another device such as a camera, binoculars, night vision scope and the like on top of searchlight 11. In this manner two units may be used in combination, namely the searchlight of the invention moved or manipulated as a single unit with an optical detection device of some sort. The entire assembly may also be place on a support tripod or mount using the housing mounting hole 302 shown in FIG. 1*a*.

Transformer 68 mounts onto base plate 234. Circuit board 248 is carried on a plurality of standoffs 250, which is shown in FIGS. 2 and 5 for the mounting of a resilient spring assisted connector 252 which engages anode nut 254 disposed onto the anode terminal 256 of xenon lamp 66. The opposing pin 258 of the resilient spring assisted connector 252 shown in FIG. 2 is disposed through circuit board 248 and secured thereto by means of a push nut 260. Pin 258 of the resilient spring assisted connector 252 is then connected by a wire or means not shown to transformer 68. A banana plug receptacle 262 is similarly connected by a wire or means not shown to lamp ground 62 of FIG. 10. Banana plug 263 as shown in FIG. 5 is connected by a wire not shown to the cathode of 264 of lamp 66 shown in FIG. 2 and is plugged into banana plug receptacle 262.

Lamp 66 is disposed in a ceramic sleeve 266 which in turn is affixed into an aluminum jacket 268 as shown in FIG. 5. The aluminum jacket 268 is disposed in a cylindrical cavity 270 defined in lamp base 272. There is sufficient clearance between aluminum sleeve 268 and cylindrical cavity 270 defined in lamp base 272 to allow a limited amount of radial displacement of sleeve 268 about the longitudinal axis of lamp housing 232 which is parallel to the longitudinal axis of symmetry of reflector 274. A pair of access holes 273 through finned heat sink 278 and lamp base 272, which holes 273 are shown in FIG. 6 in lamp base 272, allow access by means of an Allen wrench to two orthogonally positioned socket-head set screws 275 on one side of sleeve 268 and which are each opposed by a spring 277 on the opposite side of sleeve 268 to adjustably center sleeve 268 in lamp base 272. In this manner, the placement of the arc or plasma in lamp 66 can be accurately and easily adjusted in the field if need be in a plane perpendicular to the beam axis to lie precisely on axis. Because lamp base 272 is centered on the optical axis of symmetry of reflector 274 best shown in FIG. 5, lamp 66 can thus be adjusted in the field to be optically aligned onto the axis of symmetry of reflector 274. Hence, the beam of light from lamp 66 can be focused for maximum collimation.

Lamp base 272 is disposed in a cylindrical bore 276 defined in fluted heat sink 278 thus as best visualized in cross-sectional view of FIG. 4. Fluted heat sink 278 also includes bosses 284 which mate with molded standoffs 242 of housing 232 and are connected thereto by screws 286 disposed in threaded bore 287 defined in bosses 284 and standoffs 242 as shown in FIG. 2. Lamp base 272 is disposed into cylindrical bore 276 until radial flange 280 of lamp base 272 makes contact with shoulder 282 of fluted heat sink 278. It will be appreciated from the description below that reflector housing 284 shown in FIG. 5 can be easily detached from the front of searchlight 11 by unscrewing reflector housing 284 from the front of lamp base 272 as best seen in FIG. 4. This then allows lamp base 272 to be withdrawn from cylindrical bore 276, unplugging banana plug 263 from banana socket 262. Lamp 66, ceramic sleeve 266 and aluminum jacket 268 are thus handled as a unit with lamp base 272. If lamp 66 burns out, then it can readily be removed in the field as a unit without special tools or procedures in the manner just described above with the old lamp base 272 and a new lamp base 272 with a new lamp 66, ceramic sleeve 266 and aluminum jacket 268 inserted. This has the advantage that new lamp 66 is already electrically assembled in an operative unit and is optically aligned with the optical axis of reflector 274. Such easy field replaceability has a high value in search and rescue equipment.

Figure 3A:
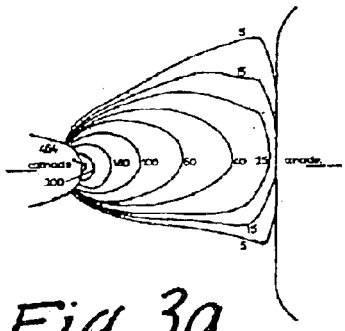
FIGS. 3*a*–3*d* are depictions of the anode-rear positioning and the consequent benefit as compared to prior art anode-forward positioning.
Figure 3B:
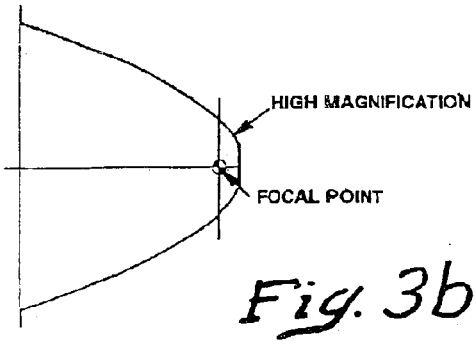
Figure 3C:
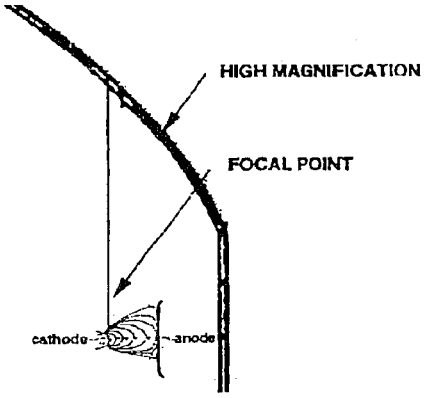
Figure 3D:
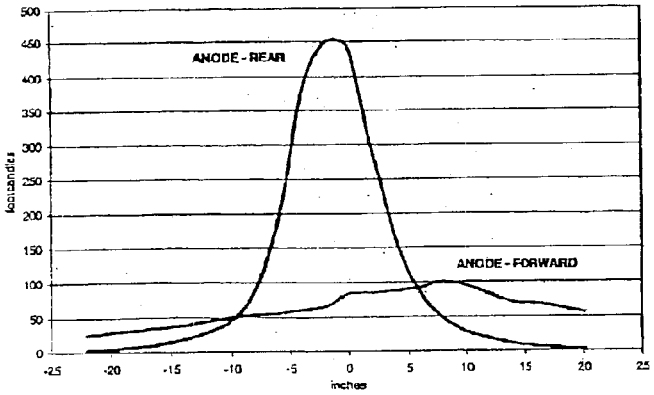

With lamp anode 256 uniquely oriented toward the rear or light housing 232 away from reflector 274, it is been determined that the field of illumination from lamp 66 is slightly convergent in the far-field and much more concentrated with conventional xenon arc lamps than would occur if the direction or orientation of the lamp were reversed, i.e. with the cathode in the rearward condition. This is due to positioning the full luminance distribution of the arc (FIG. 3*a*) in the high magnification (behind the focal point, FIG. 3*b*) section of the parabolic reflector (FIG. 3*c*), instead of in the low magnification for prior art anode-forward configurations. The resulting illuminance is significantly greater than in anode-forward, as shown in FIG. 3*d*. Hence with the lamp anode 256 in the rear position as shown in FIG. 5, a hole in illumination or lessening of variation of intensity in the central part of the spot or beam is reduced.

The anode-to-the-rear orientation also means that more heat is projected back into the searchlight toward circuit board 248. Finned heat sink 278 is provided and thermally connected to lamp housing 272 to ameliorate this condition. A metal heat sink block 235 shown in FIG. 5 is coupled to circuit board 234 to make thermal contact with fluted heat sink 274 by means of a pair of fingers 273. Fingers 273 clasp a mating internal heat sink flange (not shown) of heat sink 278.

Reflector housing 284 has an internal collar 287 provided with threading 288. Threading 288 engages threading 290 defined in the outer cylindrical extension of lamp base 272. Thus, when assembled into housing 232, reflector housing 284 screws onto lamp base 272 to further control the accuracy of rotation, as shown in FIG. 4. A tight tolerance sleeve and ring are used to stabilize the rotation. Reflector 274, which is described below, is attached to reflector housing 284, and thus may be longitudinally advanced or retracted along this longitudinal axis by rotation of reflector housing 284. The longitudinal axis of reflector housing 284 is coincident with the longitudinal axis or optical axis of 274. This allows for variable collimation of the beam of light.

Reflector 274 is disposed in reflector housing 284 so that forward flange 290 of reflector 274 abuts a shoulder 292 of reflector housing 284 as shown in FIG. 2. Reflector 274 is attached to reflector housing 284 by means of an adhesive sealant. Screws 294 connect reflector housing 284 to a bezel 298. Thus, bezel 298 thereby clamps a front transparent (or special ultraviolet, colored or infrared filter) faceplate 299 against a gasket 300, reflector 274 and shoulder 292 of reflector housing 284. A bezel ring 297 is threaded into an interior thread defined in bezel 298. Reflector housing 284 is completely sealed for water resistance and tempered glass window 299 is designed to be usable in hazardous environments. Reflector housing 284 and reflector 274 thereby rotate as a unit and are threaded onto lamp housing 272. An 0-ring and groove combination 303 is defined the exterior surface of reflector housing 284 to provide for water sealing. Reflector housing 284 as described above is threaded to lamp housing 272 which allows lamp 66 to be longitudinally moved and focused inside of reflector 274 as stated. Lamp housing 272 is fixed with respect to heat sink 278 and hence body 232 by means of two cupped set screws 310 shown in FIG. 6 threaded into heat sink 278 and bearing against lamp housing 272 which slip fits into heat sink 278. Thus, by loosening set screws 310, which have exterior access holes 312, the entire head assembly of searchlight 11 can be removed including lamp housing 272. Lamp housing 272 can then be unscrewed from reflector housing 284 and then replaced.

The rotation of reflector housing 284 about lamp housing 272 and hence heat sink 278 is better depicted in the perpendicular cross-sectional view of FIG. 7. Heat sink 278 has a finger which extends from one of the fins forwardly or to the right in FIG. 2 so that it is in interfering position with stops 316 screwed to and carried on reflector housing 284. Therefore, as bezel 298 is rotated by hand, thereby rotating reflector housing 284 with it, its rotation is limited to one revolution or slightly less by the interference between fixed finger 314 and rotating stops 316. In this manner the head assembly cannot be inadvertently unscrewed from lamp housing 272, and further the focus range of lamp 66 as it is longitudinally moved on the optical axis of reflector 274 is retained within a desired or optimal range.

Reflector 274 may be moved by hand as described by rotating reflector housing 284 or maybe adjusted by means of an electric motor or lever adjustment (not shown). The lamp is focused by positioning the arc gap in lamp 66 at the focal point of reflector 274.

Also included within bezel 298 may be a filter body carrying a filter (not shown) disposed on or adjacent to faceplate 299. The filter body screws into an interior thread defined in the inner diameter of bezel 298 or may be clamped between bezel ring 297 and bezel 298. Filters may be chosen according to the purpose desired for providing a effective spotlight in smoky conditions, for ultra violet radiation, infrared radiation or for selecting a frequency band of illumination effective for underwater illumination. Filters may also be employed for attenuation of light intensity in lower illumination applications, such as often occur in infrared applications.

The present invention provides a unique circuit topology for providing the current and voltage necessary to ignite, sustain and to adjust the operation of an arc lamp and in particular a xenon lamp in a portable, hand-held battery operated light. The challenge is to provide the current and voltage requirements necessary to ignite and sustain an arc lamp from a wide range of the supply input voltage. Therefore, before considering the circuitry of the invention consider the typical current and voltage requirement xenon arc lamp graphically depicted in FIGS. 8 and 9 as a function of time.

Figure 8:
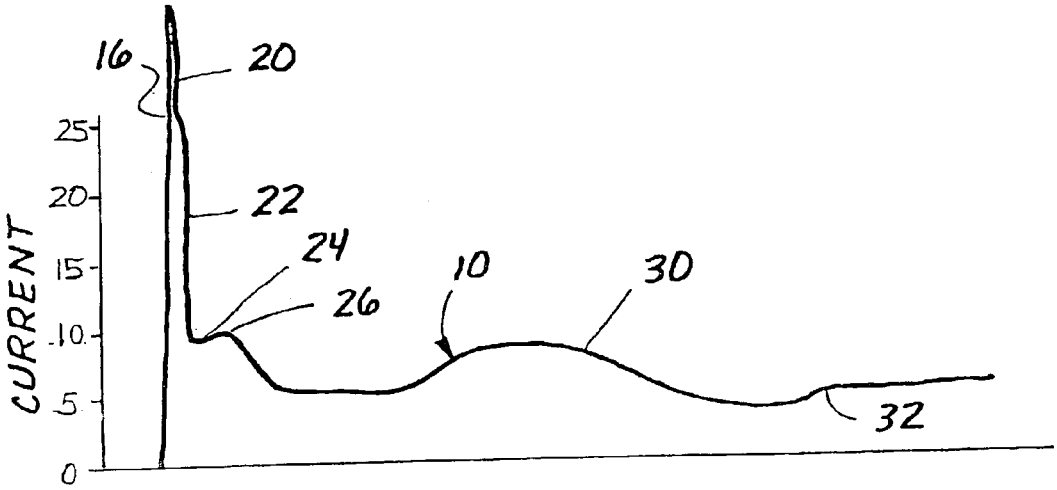
FIG. 8 is a simplified graph of the current as a function of time in a xenon arc lamp.
Figure 9:
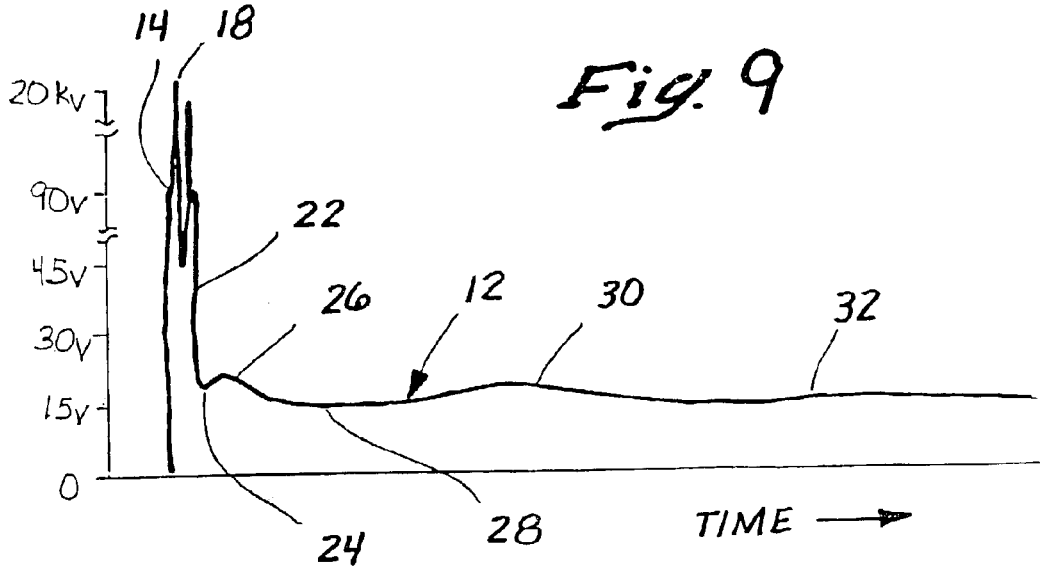
FIG. 9 is a simplified graph of the voltage as a function of time in a xenon arc lamp.

FIG. 8 is a graph of the current supplied to a xenon lamp as a function of time, while FIG. 9 shows the graph of the voltage as a function of time. FIGS. 8 and 9 are aligned with respect to each other so that equal times appear at equal positions on the x-axis of each graph. Curve 10 of FIG. 8 illustrates the current of a xenon lamp while curve 12 in FIG. 9 illustrates the voltage. The lamp is turned on at time t=0. The power supply, described below turns on and rises quickly, i.e. within about 2 milliseconds, to provide a 90 volt dc open circuit voltage across the lamp at time 14 in FIG. 9. In the illustrated embodiment a 20 kilovolt RF pulse is generated at time 18 shown in FIG. 9 to start ignition of the lamp. The power rises rapidly to 100–125 watts. In the illustrated embodiment the RF pulse is about 400 kHz although many other frequencies and range of frequencies can be utilized without departing from the scope of the present invention. Typically the lamp is ignited within a short time, about one millisecond or less during which the current quickly falls as shown by falling edge 20 in FIG. 8. During this time a current is delivered from a storage capacitor at time 22 to deliver additional energy to heat the plasma and lamp electrodes in order to sustain its operation.

As will be described below, a converter circuit holds the heating power at time 24 in FIG. 9 to deliver the additional current. Once the lamp is started the converter may deliver a constant or regulated current to the lamp at any power level, although typically most lamps are only stable within the range of plus or minus 15 percent of the rated lamp current beginning at time 28 in FIG. 9. According to the invention, the lamp is started at an optimal power level for the lamp in question. From this point forward the current supply to the lamp and the intensity of its light output can be smoothly transitioned to any level within an operational range without visually perceptible stepped transitions or altered in a step change manner. For example, in the illustrated embodiments the user may manually manipulate the controls as described below to increase the current to a maximum power and brightness at time 30 in FIG. 9, thereafter at a later time smoothly decreasing the current and brightness of the lamp to a minimum power level at time 32 in FIG. 8.

Figure 10:
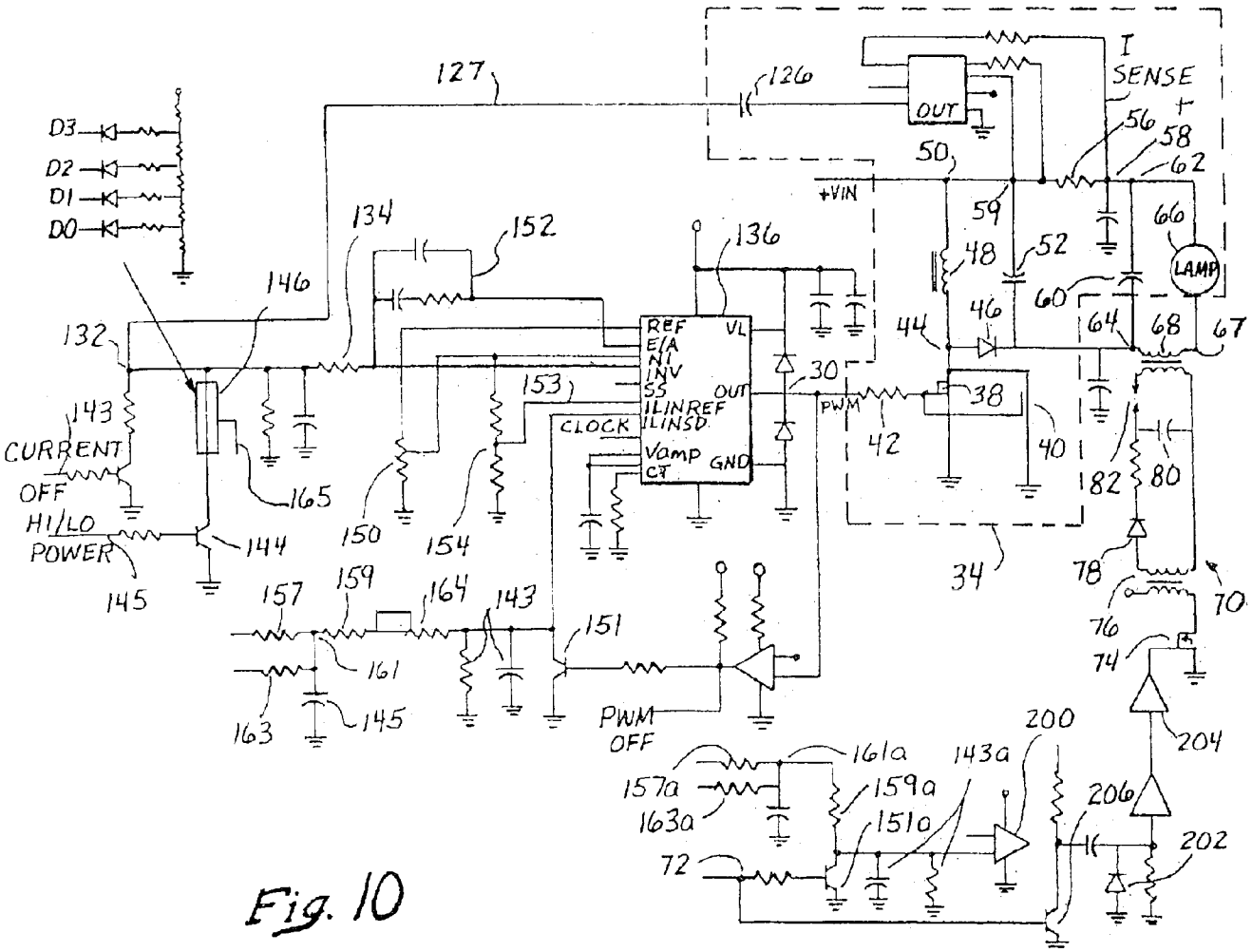
FIG. 10 is a simplified schematic diagram of the pulse width modulator, converter and ignition circuit of the arc lamp of the invention.

The general time profile of the current and voltage of the xenon lamp through its phases of operation now having been illustrated in connection with FIGS. 8 and 9, turn to the schematic diagram of FIG. 10 wherein the pulse width modulator (PWM), converter, lamp circuit and igniter are illustrated. FIG. 10 is a simplified circuit schematic which illustrates the essential operation of the invention. It must be understood that many conventional circuit modifications for electromagnetic interference (EMI), circuit spike protection, temperature compensation and other conventional circuit modifications could be made in the circuit of FIG. 10 without departing from the spirit and scope of the invention.

The converter, generally noted by reference numeral 34, is controlled by a signal, PWM, on input 36. Input 36 is coupled to the gates of a pair of parallel FET'S 38 and 40 through an appropriate biasing resistor network, collectively denoted by reference numeral 42. The parallel FETs 38 and 40 contribute to the high efficiency of the circuit which results in a high conversion of the battery power to useful illumination. A light made according to the invention produces a beam twice the distance as conventional lights or xenon searchlights running at the same power.

The source node of transistors 38 and 40 are coupled to node 44 which is coupled to the input of diode 46 and to one side of inductor 48. The opposing side of inductor 48 is coupled to the supply voltage, +VIN 50. Also coupled between supply voltage 50 and the output of diode 46 is a storage capacitor 52. Energy is stored in capacitor 52 from converter 34 and is delivered as additional energy to heat the plasma and lamp electrodes to sustain its operation as was described in connection with FIGS. 8 and 9 in connection with time 26.

Node 54, also coupled to the output of diode 46 and one end of capacitor 52 is the voltage of the lamp power supply, VSENSE+. The current of the lamp power supply is measured by measuring the voltage drop across resistor 56 and is designated in FIG. 10 as the signals I SENSE+ and I SENSE−. The converter or power supply output is thus formed across nodes 54 and 58 and is delivered to a bank of filtering capacitors, collectively denoted by reference numeral 60. The lamp DC ground is thus provided at node 62 while the filtered converted lamp power is provided at node 64.

Xenon arc lamp 66 is coupled between lamp ground 62 and a lamp high voltage node 67. The lamp current supply from node 64 is coupled across the secondary coil of transformer 68. The primary of transformer 68 is coupled to the igniter, generally denoted by reference 70. The igniter takes its input from a signal, TRIGGER DRIVE 72, which is a 40 kHz signal which is ultimately communicated to the gate node of igniter transistor 74 in a manner described below. Igniter transistor 74 is coupled in series with the primary of transformer 76. The secondary of transformer 76 is coupled to diode 78 and then to an RC filter 80 for deliverance of a high voltage RF signal to a spark gap 82. When the voltage has reached a pre-determined minimum, the current will jump the spark gap 82, and current will then be supplied to the primary of transformer 68. In this manner, the 40 kHz RF pulse which is generated to start the ignition of lamp 66 is delivered to lamp high voltage node 67.

Before considering further the circuit used for the high voltage RF trigger communicated to the gate of transistor 74, consider first how the current to lamp 66 is controlled through PWM 136, which in the illustrated embodiment is a Unitrode model UC3823 pulse width modulator. Understanding how this is achieved will then facilitate an understanding of the control of the ignition trigger. One of the main problems to light a xenon lamp has been the initial ignition phase. In the past a high voltage is applied across the lamp (approx. 100 volts), the gas is ionized with a high voltage RF pulse (>10,000 volts) and a large capacitor is used to supply the energy to heat the plasma before reaching the normal running voltage which is about 14 volts for a 75 Watt lamp.

When using a switching power supply to run lamp 66 the conventional configuration is to use a "Boost Converter", that is to boost the 12 volts from the battery supply to the running voltage of the lamp. The problem with this type of power converter is that the input voltage must be lower then the output voltage. This causes problems with the operation in many conventional automobiles for example, as the normal battery voltage can be over 14 volts. In the system of the invention an "Inverted Buck-Boost Converter" is used. This allows the converter to supply the proper lamp voltage while the input voltage can be anywhere from 10 to 28 volts.

In a conventional system, the starting high voltage is generated by running the converter in open loop and fixing the voltage to about 100 volts by setting the converter to a fixed duty cycle. This voltage also charges the capacitor that supplies the heating energy. The problem with this is that the converter must also supply power during the heating phase. During this heating phase the converter must supply more power than the running power for a short time. Because the duty cycle is fixed, changes in the input voltage will cause large changes in the power being supplied during this phase. A 10% increase in input voltage could cause, for example, the converter to try to supply more power than it is capable of producing. This will cause it to shutdown due to excessive current demand. The reverse, namely a 10% lower voltage in the input supply voltage, causes the converter not to supply enough power thereby causing the lamp not to light. The other problem is the converter must change from open-loop to closed-loop control to regulate the power being supplied to the lamp.

In the system of the invention, the heating power is semi-regulated by sensing the input voltage being supplied and adjusting the open-loop duty cycle. This relationship from voltage to duty cycle is not a one-to-one relationship. By using a percentage of the input voltage to adjust the RC time constant the resultant power delivered to the load will remain constant.

Turn again to FIG. 10 for a concrete illustration of this principle. The input voltage, +VIN, on one side of resistor 157 together with the fixed voltage supplied on resistor 163 (here shown as +10 volts) is summed at the junction 161 of resistors 157, 163, and 159. This summed voltage is the slope and offset adjusted voltage and is used to set the minimum duty cycle. Capacitor 145 filters this signal and provides a low pass filter. Resistors 159 and variable resistor 163 with capacitor 143 provide the RC time constant for the circuit, which is presented at node 147. Node 147 is coupled to current shutdown pin (ILIM/SD) on PWM 136. When the PWM output drive 36 coupled into FETs 38 and 40 is high, the RC circuit just described charges. When a predetermined threshold voltage is reached the PWM signal is turned off. This will keep the power constant across lamp 66 during the heating phase over the total operating input range of the supply from 10 to 32 volts.

When PWM drive 36 is low, capacitor 143 is reset through voltage discriminator 149 coupled to the gate node of transistor 151. When transistor 151 is turned on by discriminator 149, capacitor 143 is discharged to ground. Discriminator 149 is active high whenever PWM 36 drops below the reference voltage provided at the other input to discriminator 149, which in the illustrated embodiment is +5.1 volts. When PWM 36 goes high, the RC node 147 begins to charge and voltage on node 147 rises until it reaches a fixed threshold. At this point PWM 136 turns off PWM drive 36 and the cycle repeats. A percentage of the input supply voltage, +VIN, is coupled through resistors 157, 159, and 163 and is used to adjust the RC time constant at node 147 so that the resultant power delivered to lamp 66 remains constant even when there is a wide variation in the supply voltage. Variations in the DC power supply between 11 to 32 volts is easily accommodated by the claimed invention.

Consider now the circuitry used to provide the trigger to ignition transistor 74. Analogous circuitry is used to control the ignition trigger as was just described for the control of PWM drive 36. Resistors 157*a*, and 163*a* coupled to capacitor 145*a* perform the same function and form the same circuit combination as resistors 157, and 163 coupled to capacitor 145. Node 161*a* where resistors 157*a*, and 163*a* and capacitor 145*a* are coupled together is in turn coupled to resistor 159*a* and capacitor 143*a* which perform the same function and form the same circuit combination as resistor 159 and capacitor 143. The ignition signal, TRIGGER, is coupled to the gate of transistor 151*a* which in turn discharges RC node 147*a* in a manner as previously described in connection with PWM drive 36. TRIGGER is generated by programmable logic device (PLD) 164 described below.

RC node 147*a* is coupled to one input of voltage discriminator 200, whose other input is coupled to a reference voltage, i.e. +2.5 V. In this way a threshold value is set for TRIGGER. When TRIGGER is not active, RC node 147*a* charges up and when the threshold is exceeded will be output from discriminator 200, filtered by filter 202, signal conditioned by inverters 204 and provided to the gate of transistor 74, the driver to the primary of the ignition transformer 76. When TRIGGER goes active, RC node 147*a* is discharged and the output of discriminator 200 is pulled to ground through pull-down transistor 206. Again, a percentage of the input supply voltage, +VIN, is coupled through resistors 157*a*, 159*a*, and 163*a* and is used to adjust the RC time constant at node 147*a* so that the resultant power delivered to lamp 66 during ignition remains constant even when there is a wide variation in the supply voltage.

Figure 11:
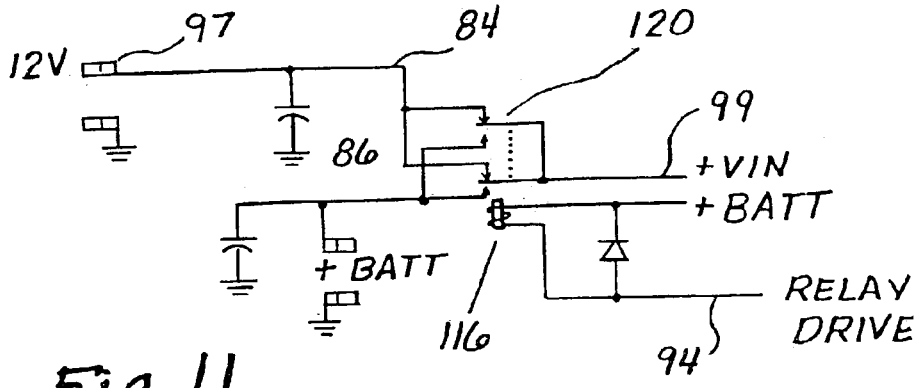
FIG. 11 is a simplified schematic diagram of the power supply circuit of the invention.

Consider now the power supply for converter 34. The searchlight may be powered either by an external 12 volt power supply provided line 84 shown in FIG. 11 or by the current from an internal battery, +BATT, line 86 of FIG. 11. The manual operation of the lamp is provided by means of a closure of a push button switch 88 shown in FIG. 14 which is used to provide a grounded signal, RELAY DRIVE from PLD 164. When RELAY DRIVE goes active, relay 116 is energized and the supply voltage, +VIN, on line 99 is switched to the internal battery, +BATT. When RELAY DRIVE goes inactive, relay 116 is de-energized and the supply voltage, +VIN, is switched to an external terminal 97. Either an externally provided power supply signal or the battery power supply is provided by means of control of a double pole-double throw relay 116 powered by the signal, RELAY DRIVE, on line 94. Contacts 120 of relay 116 thus either provide an exterior power supply voltage 122 or the battery voltage, +BATT, as the circuit power supply 50, +VIN.

FIG. 15 illustrates the circuit for a battery charger controller 104 provided within the searchlight to charge the battery. A signal, CHG DRIVE, is provided from PLD 164 on input 96 to the gate to controller 104. The signal, SENSE+, from node 54 is also coupled as an input to controller 104 from converter 34. Battery charger controller 104 is a conventional integrated module.

The converter and igniter circuitry and battery supply current now having been described, turn to the control circuitry of FIG. 10. The current sensing nodes 58 and 59, I SENSE− and I SENSE+ respectively, are provided as inputs to a transconductance amplifier 124 which is characterized by high impedance and provides an amplified voltage output to the input of diode 126. In the illustrated embodiment a Maxim high-side, current-sense amplifier model 472 is used. The output of diode 126 is fed back on line 127 to node 132. The voltage at node 132 is provided through resistor 134 to the inverted input pin, INV, of pulse width modular 136. Pulse width modulator 136 produces from its various inputs a PWM drive 36 which was described above as being coupled to the input of converter 34. The other inputs and outputs of pulse width modular 136 are conventional and will thus not be further described unless relevant.

The signal provided on node 132 is affected by several adjustments. Node 132 is resistively coupled to transistor 142 whose base is controlled by control signal, CURRENT OFF, also output from PLD 164. Thus, when transistor 142 are turned on, node 132 is pulled low. This causes PWM drive 36 to go low.

Node 132 is also resistively coupled to ground through transistor 144 whose base is resistively coupled to a control signal, HI LO POWER as provided by PLD 164. The emitter of transistor 144 is coupled to node 132 through a conventional binary coded decimal (BCD) resistive ladder 146 so that the maximum current on node 132 is continuously and smoothly digitally controlled as it is adjusted from high to low power and visa versa. Binary coded decimal (BCD) resistive ladder 146 is controlled by the BCD output 165 from PLD 164 so that the amount of resistance provided by ladder 146 is digitally controlled and varied in amounts which are visually imperceptible when hi/lo power is active.

The control signal to input NOT INVERTED (NI) of pulse width modulator 136 is controlled through an adjustable resistive network, collectively denoted by reference numeral 150. The control signal E/A OUT of pulse width modulator 136 is similarly provided from a filter network 152 for the purpose of rejecting unwanted frequencies. The control signal 153, (ILM REF) is similarly provided from a biasing network 154 with the purpose of setting the threshold voltage at which RC node 147 will cut off PWM drive 36. A CLOCK signal is provided from pulse width modulator 136 to PLD 164 for the purposes of clocking programmable logic device 164 shown in FIG. 14.

Figure 12:
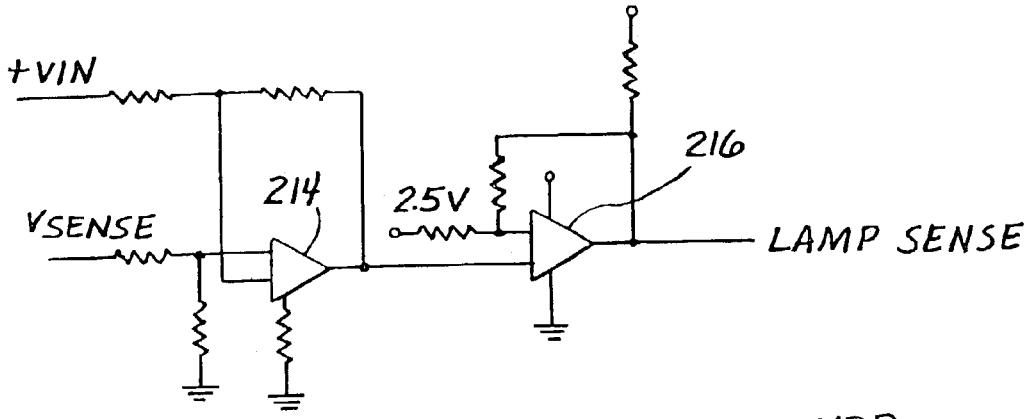
FIG. 12 is a simplified schematic diagram of a lamp current sensing circuit of the arc lamp of the invention.

The lamp high voltage set point is produced in part by the circuitry of FIG. 12. High voltage from node 54, V SENSE+, is resistively provided to the input of differential amplifier 214. The opposing input of amplifier 214 is resistively coupled to the supply voltage +VIN, and the output of feedback amplifier 214 is then provided to one input of differential amplifier 216 whose other output is coupled to the +2.5 volt reference. The output of feedback amplifier 216 is the command signal +LAMP SENSE, which is provided as one of the inputs to PLD 164 and which provides a feedback signal of what the voltage on lamp 66 is.

The control of light intensity and many other lamp control functions are provided by PLD 164 which is a conventional programmable logic device such as model XC9572 manufactured by Xilinx. The programming of PLD 164 is conventional. The input signals to PLD 164 include CLOCK, +VIN, +LAMP SENSE and PWM, , while the output signals are CURRENT OFF, RELAY, TRIGGER, Hi LO POWER whose functions are described above. Push button 88 is programmed in PLD 164 so that a single momentary depression of push button 88 turns on the light. A second single momentary depression of push button 88 turns off the light. However, when push button 88 is turned on and held on for more than a few seconds, HI/LO POWER goes active and BCD signals 165 begin to count up causing resistance ladder 146 to be driven to gradually increase the power. As long as button 88 is held down, BCD signals 165 count up and light intensity increases. As soon as button 88 is no longer depressed, counting stops and the light intensity remains fixed. If the light is turned off and then turned on again, it will light at the light intensity that was last chosen. The BCD signals 165 count cyclically, i.e. after reaching the maximum count, BCD signals 165 return to the minimum count and hence minimum light intensity. The cycle is then repeated. If desired, PLD 164 could also be programmed to count down or in the opposite direction of light intensity variation. Push button 88 can be programmed in PLD 164 in many different ways from that described without departing from the spirit and scope of the invention.

Figure 13:
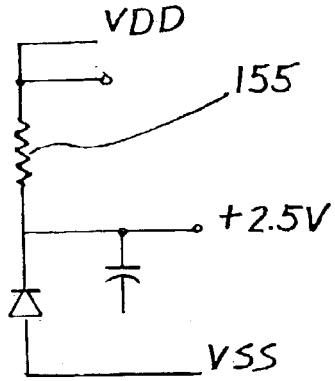
FIG. 13 is a simplified schematic diagram of a reference voltage circuit of the invention.

FIG. 13 is a schematic which shows a conventional manner in which the 5.0 and 2.5 volt reference signals are respectively generated using resistor divider 155.

The circuitry now having been described in detail, several observations can be made. The circuit, as previously stated is markedly more efficient in producing light from lamp 66 than prior circuits. This is due to several factors. First, the use of parallel switching FETs 38 and 40 described above contributes to increased power conversion efficiency into light output. Second, the use of a high voltage battery may contribute. Typically, battery voltages of 12 volts are employed. In the present invention batteries with outputs in the range of 16–22 volts are used. Third, converter 34 is run at a higher switching frequency. Whereas prior circuits are operated at about 20 kHz, the present invention is configured to drive converter 34 at a much higher frequency, such as 100 kHz.

Figure 16:
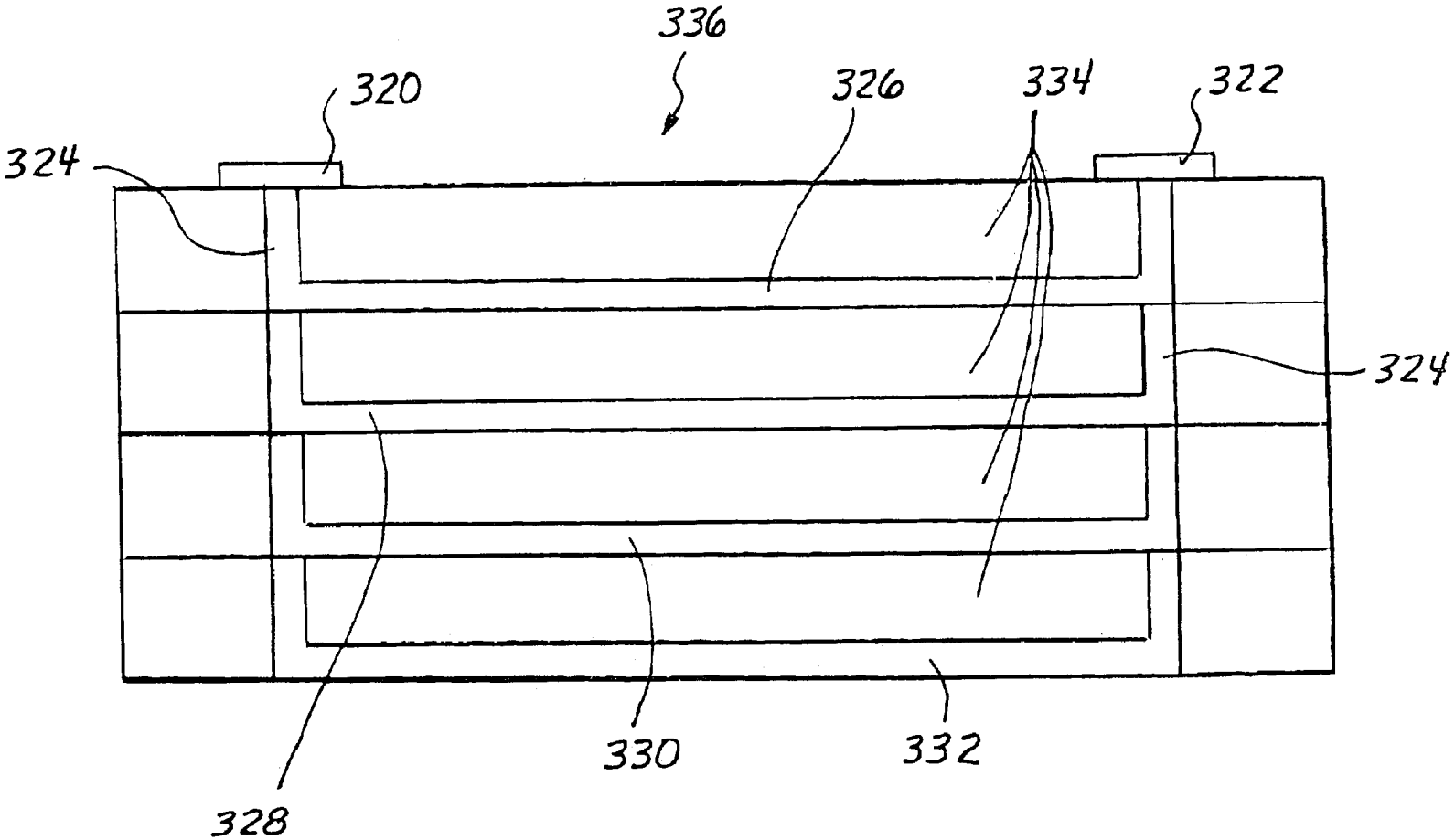
FIG. 16 is a side cross-sectional view of a printed circuit board showing multiple conductive paths for high current circuit segments.

Finally, the circuit boards are laid out and fabricated to minimize power losses in the lines. A four layer printed circuit board is used. In high current lines such as the circuit path from +VIN to node 50, inductor 48 and FETs 38 and 40, and in the power lines in FIG. 11, lines 97, 84, 120, and 86, multiple printed circuit board lines are fabricated in parallel for the same line on the schematic. For example, in each of the lines just mentioned four parallel printed circuit board lines are fabricated and coupled in parallel with each other as shown in FIG. 16. For example, pads 320 and 322 diagrammatically represent nodes in the circuit between which a high current occurs. The circuit board, generally denoted by reference numeral 336, is comprised of four layers 334. A vertical riser or via 324 is defined from pads 320 and 322 through all four layers 334. Vias 324 are coupled with wide and thick conductive printed circuit lines 326, 328, 330 and 332 disposed on the bottom of each of layers 334. Circuit lines 326, 328, 330 and 332 are in parallel circuit with each other and therefore provide a very low resistance, low loss line for high current loads.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims.

The words used in this specification to describe the invention and its various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

We claim:

1. An apparatus for producing a high intensity beam of light with high efficiency of conversion of electrical power into light intensity comprising: a xenon or metal halide arc lamp; a high frequency/high efficiency electronic ballasting circuit coupled to said arc lamp operating at a frequency substantially greater than 20 kHz; a battery coupled to said ballasting circuit for powering said ballasting circuit and said arc lamp, said battery having a voltage greater than 12 volts; and a converter circuit coupled to both said battery, said ballasting circuit and said arc lamp for converting DC voltage from said battery to pulse width modulated switched current to said arc lamp in which said DC voltage is switched by parallel switching transistors.

2. The apparatus of claim 1 wherein said high frequency electronic ballasting circuit coupled to said arc lamp operates at a frequency approximately equal to 100 kHz.

3. The apparatus of claim 1 wherein said battery has a voltage of approximately 22 volts.

4. The apparatus of claim 1 further comprising a printed circuit board on which said ballasting circuit and converter circuit are disposed, said printed circuit board having multiple layers of conductors, high current paths in said ballasting circuit and converter circuit being provided with multiple parallel conductors within said multiple layers so that power losses are minimized.

5. The apparatus of claim 4 wherein said printed circuit board has at least four multiple layers of conductors, and wherein said high current paths are realized with at least four parallel conductors.

6. An apparatus for producing a smoothly adjustable high intensity beam of light comprising: a xenon or metal halide arc lamp; a high frequency/high efficiency electronic ballasting circuit coupled to said arc lamp; a power source coupled to said ballasting circuit for powering said ballasting circuit and said arc lamp; and a converter circuit coupled to both said power source, said ballasting circuit and said arc lamp for converting DC voltage from said power source to pulse width modulated switched current to said arc lamp, wherein said ballasting circuit is controllable by a switch to vary current supplied to said converter circuit and hence intensity of light output from said arc lamp by a sequence of discrete steps in current and hence in intensity of said lamp which discrete steps in intensity of said lamp are not visually perceptibly different between one step to a next step in said sequence of steps of said current to said lamp.

7. The apparatus of claim 6 comprises a contact switch, a digitally controlled resistance ladder in said ballasting circuit and a programmable logic device coupled to said contact switch and resistance ladder to produce a sequence of digital commands in response to activation of said contact switch to cycle said digitally controlled resistance ladder through said sequence of steps.

8. The apparatus of claim 6 where said sequence of steps begins at a minimum light intensity of said arc lamp and increases to a maximum light intensity of said arc lamp.

9. The apparatus of claim 8 where said sequence of steps after reaching said maximum light intensity of said arc lamp returns to said minimum light intensity of said arc lamp.

10. An apparatus comprising: an arc lamp; a high frequency/high efficiency electronic ballasting circuit coupled to said arc lamp, a timing circuit being included in said ballasting circuit; a DC power source coupled to said ballasting circuit for powering said ballasting circuit and said arc lamp, said power source having a wide range of possible voltage output levels of approximately 11–32 volts; and a converter circuit coupled to both said power source, said ballasting circuit and said arc lamp for converting DC voltage from said DC power source to a pulse width modulated switched current to said arc lamp, wherein said ballasting circuit controls current supplied to said arc lamp by feeding a percentage of said voltage output level from said DC power source to said timing circuit, said timing circuit generating a timing signal at a time which is dependent on said percentage of said voltage output level from said DC power source coupled to said timing circuit, said timing signal coupled to said ballasting circuit to modify said pulse width modulation of said converter circuit and hence current supplied to said arc lamp so as to operate said arc lamp notwithstanding changes in said DC voltage output level of said DC power source.

11. The apparatus of claim 10 where said timing circuit is an RC charging circuit which is charged to a predetermined threshold level by said percentage of said voltage output level from said DC power source and wherein a pulse width of said pulse width modulation is shortened when said predetermined threshold level is reached unless terminated earlier by a predetermined pulse width of said pulse width modulation.

12. The apparatus of claim 10 wherein said converter circuit includes an ignition circuit for providing an initial high voltage radio frequency current to said arc lamp to create a glowing plasma within said arc lamp, wherein said ignition circuit controls current supplied to said arc lamp by feeding a percentage of said voltage output level from said DC power source to an ignition timing circuit, said ignition timing circuit generating an ignition timing signal at a time which is dependent on said percentage of said voltage output level from said DC power source coupled to said ignition timing circuit, said ignition timing signal determining pulse width duration of said radio frequency current supplied to said arc lamp so as to reliably ignite said arc lamp notwithstanding changes in said DC voltage output level of said DC power source.

13. The apparatus of claim 12 where said ignition timing circuit is an RC charging circuit which is charged to a predetermined threshold level by said percentage of said voltage output level from said DC power source and wherein a pulse width of said radio frequency current is shortened when said predetermined threshold level is reached unless terminated earlier by a predetermined pulse width of said radio frequency current.

14. An apparatus for generating a beam of light comprising: an arc lamp; a high frequency/high efficiency electronic ballasting circuit coupled to said arc lamp; a battery coupled to said ballasting circuit for powering said ballasting circuit and said arc lamp; and a multi-purpose converter circuit coupled to both said battery and said arc lamp for providing both power to said arc lamp and for recharging said battery from an external power source.

15. The apparatus of claim 14 comprising a housing in which said battery is included with said battery, converter circuit, ballasting circuit and arc lamp as a single compact unit.

16. The apparatus of claim 14 wherein said ballasting circuit is controlled by a control circuit to turn said arc lamp on at minimum intensity levels of operation.

17. The apparatus of claim 14 wherein said ballasting circuit comprises a lamp current circuit having output coupled across said arc lamp for providing a converted dc current and voltage to said arc lamp; and an igniter coupled across said arc lamp to provide a high voltage RF ignition current to said arc lamp wherein said lamp current circuit is controlled by a smooth variation of current to said arc lamp to correspondingly smoothly vary light output from said arc lamp between high and low intensities by visually imperceptible amounts.

18. The apparatus of claim 17 wherein said lamp current circuit is controlled to provide said smooth variations between high and low intensities by a multiplicity of small digital current steps.

19. The apparatus of claim 17 wherein said lamp current circuit is controlled to provide said smooth variations between high and low intensities by an approximate analog variation in current intensity provided to said arc lamp.

* * * * *